US007921624B2

(12) United States Patent
Ours et al.

(10) Patent No.: US 7,921,624 B2
(45) Date of Patent: Apr. 12, 2011

(54) UNITARY TRANSPORTER BASE AND SHAPER AND SLIP FRAME FORMER FOR FORMING A TRANSPORTABLE CONTAINER

(75) Inventors: Dave Ours, Marshall, MI (US); Sharon Juntunen, Portage, MI (US)

(73) Assignee: Kellogg Company, Battle Creek, MI (US)

( * ) Notice: Subject to any disclaimer, the term of this patent is extended or adjusted under 35 U.S.C. 154(b) by 69 days.

(21) Appl. No.: 12/478,800

(22) Filed: Jun. 5, 2009

(65) Prior Publication Data

US 2009/0301036 A1 Dec. 10, 2009

Related U.S. Application Data

(60) Provisional application No. 61/059,027, filed on Jun. 5, 2008.

(51) Int. Cl.
*B65B 11/58* (2006.01)
*B65B 43/58* (2006.01)
*B65B 43/62* (2006.01)

(52) U.S. Cl. ..... 53/399; 53/441; 53/442; 53/449; 53/556; 53/557; 53/176; 53/587

(58) Field of Classification Search ..... 53/399, 53/441, 442, 449, 459, 469, 556, 557, 587, 53/173, 176, 570, 284.7; *B65B 11/58, 43/58, B65B 43/59, 43/62*

See application file for complete search history.

(56) References Cited

U.S. PATENT DOCUMENTS

| | | | |
|---|---|---|---|
| 98,848 | A | 1/1870 | Chanute et al. |
| 147,944 | A | 2/1874 | Keen et al. |
| 887,242 | A | 5/1908 | Frank |
| 1,061,394 | A | 5/1913 | Michener, Jr. |
| 1,466,724 | A | 9/1923 | McMeans |
| 1,474,625 | A | 11/1923 | Eckert |

(Continued)

FOREIGN PATENT DOCUMENTS

| | | | |
|---|---|---|---|
| DE | 574994 | C | 4/1933 |

(Continued)

OTHER PUBLICATIONS

International Search Report, Dated Nov. 13, 2009, 7 Pages for PCT/US2009/046351.

(Continued)

*Primary Examiner* — Stephen F Gerrity
(74) *Attorney, Agent, or Firm* — Dickinson Wright PLLC

(57) ABSTRACT

The present invention relates to a method of producing a transportable container for bulk goods. A bag is placed through a former opening of a slip frame former which surrounds a portion of the bag. The bag receives the bulk goods from a feed source. A stretch wrap is disposed radially about a bottom support and a portion of the slip frame former to initially form the transportable container. At least one of the slip frame former and the bottom support moves relative to other in response to the fill level of the bulk goods in the bag. During filling, the slip frame former is maintained at a position surrounding the fill level of the bulk goods in the bag. As the fill level increases in the bag, previously disposed portions of stretch wrap are disengaged from the slip frame former to squeeze the filled portions of the bag and lock together the bulk goods as additional portions of stretch wrap are disposed around the slip frame former.

26 Claims, 7 Drawing Sheets

U.S. PATENT DOCUMENTS

| | | | | |
|---|---|---|---|---|
| 1,590,086 | A | | 6/1926 | Day et al. |
| 1,649,362 | A | | 11/1927 | Nagel |
| 1,730,295 | A | | 10/1929 | Reuther |
| 1,777,224 | A | | 9/1930 | Reuther |
| 1,834,472 | A | | 12/1931 | Oliver |
| 1,861,147 | A | | 5/1932 | Steimel |
| 1,926,986 | A | | 9/1933 | Angier |
| 1,992,046 | A | | 2/1935 | Shomaker |
| 2,011,978 | A | | 8/1935 | Marks |
| 2,013,215 | A | | 9/1935 | Langenberg |
| 2,074,595 | A | | 3/1937 | Shackelford |
| 2,419,330 | A | | 4/1947 | Anderson |
| 2,676,739 | A | | 4/1954 | Nettekoven et al. |
| 2,683,522 | A | | 7/1954 | Mercier |
| 2,702,625 | A | | 2/1955 | Hapman |
| 2,765,816 | A | | 10/1956 | Carter |
| 2,863,475 | A | | 12/1958 | Lau |
| 3,066,817 | A | | 12/1962 | Bradshaw et al. |
| 3,260,352 | A | | 7/1966 | Sheridan |
| 3,374,599 | A | | 3/1968 | Sanders |
| 3,533,454 | A | | 10/1970 | Tinsley |
| 3,570,749 | A | | 3/1971 | Sato et al. |
| 3,578,183 | A | | 5/1971 | Larger |
| 3,593,484 | A | | 7/1971 | Dussich |
| 3,626,654 | A | | 12/1971 | Hoffler et al. |
| 3,688,893 | A | | 9/1972 | Wallace, Jr. |
| 3,707,127 | A | | 12/1972 | Palfey |
| 3,743,078 | A | | 7/1973 | Pittoreau |
| 3,758,410 | A | | 9/1973 | Liu |
| 3,776,435 | A | | 12/1973 | Smith |
| 3,778,962 | A | | 12/1973 | James |
| 3,785,410 | A | | 1/1974 | Carter |
| 3,847,290 | A | | 11/1974 | Suykens |
| 3,848,728 | A | | 11/1974 | Leibrick et al. |
| 3,879,917 | A | | 4/1975 | Bassendale et al. |
| 3,902,303 | A | | 9/1975 | King |
| 3,906,591 | A | | 9/1975 | Boiradi |
| 3,928,940 | A | | 12/1975 | Fagniart |
| 3,943,988 | A | | 3/1976 | Consorti |
| 3,944,070 | A | | 3/1976 | Cardwell et al. |
| 3,949,536 | A | | 4/1976 | Chevalier |
| 3,951,462 | A | | 4/1976 | De Francisci |
| 3,961,459 | A | | 6/1976 | Wolske |
| 3,968,626 | A | | 7/1976 | Hobbs |
| 4,007,694 | A | | 2/1977 | Fowler et al. |
| 4,042,035 | A | | 8/1977 | Boyer |
| 4,050,219 | A | | 9/1977 | Higgins |
| 4,074,507 | A | | 2/1978 | Ruf et al. |
| 4,078,358 | A | | 3/1978 | Henderson |
| 4,101,292 | A | | 7/1978 | Hogan, II |
| 4,106,261 | A | | 8/1978 | Greenawalt |
| 4,113,146 | A | | 9/1978 | Williamson |
| 4,129,054 | A | | 12/1978 | Fazis |
| 4,136,501 | A | | 1/1979 | Connolly |
| 4,149,755 | A | | 4/1979 | Handleman et al. |
| 4,182,386 | A | | 1/1980 | Alack |
| 4,205,930 | A | | 6/1980 | Handleman et al. |
| 4,219,054 | A | | 8/1980 | Carter et al. |
| 4,223,061 | A | | 9/1980 | Michaels |
| 4,227,609 | A | | 10/1980 | Gunther et al. |
| 4,234,273 | A | | 11/1980 | Handleman et al. |
| 4,249,639 | A | | 2/1981 | Vukovic |
| 4,249,839 | A | | 2/1981 | Vance |
| 4,253,507 | A | | 3/1981 | Williamson |
| 4,268,204 | A | | 5/1981 | Stellfox et al. |
| 4,299,076 | A | | 11/1981 | Humphrey |
| 4,309,861 | A | | 1/1982 | Karpisek |
| 4,333,561 | A | | 6/1982 | Schlegel |
| 4,339,040 | A | | 7/1982 | Peil et al. |
| 4,355,714 | A | | 10/1982 | Chever |
| 4,360,996 | A | | 11/1982 | Rutter |
| 4,409,776 | A | | 10/1983 | Usui |
| 4,434,603 | A | | 3/1984 | Beumer |
| 4,456,119 | A | | 6/1984 | In't Hout et al. |
| 4,500,001 | A | | 2/1985 | Daniels |
| 4,546,593 | A | | 10/1985 | Lasscock |
| 4,546,598 | A | | 10/1985 | Karpisek |
| 4,553,374 | A | * | 11/1985 | Lancaster et al. ..... 53/556 |
| 4,604,854 | A | | 8/1986 | Andreas |
| 4,607,476 | A | | 8/1986 | Fulton, Jr. |
| 4,617,683 | A | | 10/1986 | Christoff |
| 4,648,432 | A | | 3/1987 | Mechalas |
| 4,671,043 | A | | 6/1987 | Forni et al. |
| 4,706,441 | A | | 11/1987 | Chervalier |
| 4,734,292 | A | | 3/1988 | Gerardus Van Boxtel |
| 4,738,578 | A | | 4/1988 | Johnston |
| 4,753,060 | A | | 6/1988 | Furukawa |
| 4,763,955 | A | | 8/1988 | Justice |
| 4,770,287 | A | | 9/1988 | Glowatzki |
| 4,779,402 | A | | 10/1988 | Duynhoven et al. |
| 4,781,475 | A | | 11/1988 | LaFleur |
| 4,827,697 | A | | 5/1989 | Ross |
| 4,860,884 | A | | 8/1989 | Kostrewa |
| 4,883,167 | A | | 11/1989 | Shibata |
| D305,374 | S | | 1/1990 | Sahm, Jr. |
| 4,890,722 | A | | 1/1990 | Gough |
| 4,909,017 | A | | 3/1990 | McMahon et al. |
| 4,930,632 | A | | 6/1990 | Eckert et al. |
| 5,016,761 | A | | 5/1991 | Stoddard et al. |
| 5,025,925 | A | | 6/1991 | Wiklund |
| 5,042,235 | A | | 8/1991 | Hannen et al. |
| 5,046,603 | A | | 9/1991 | Odenthal |
| 5,117,750 | A | | 6/1992 | Mosier, II et al. |
| 5,125,785 | A | | 6/1992 | Langen et al. |
| 5,143,203 | A | | 9/1992 | Hinner |
| 5,203,142 | A | | 4/1993 | Kollross |
| 5,203,671 | A | * | 4/1993 | Cawley et al. ..... 53/588 |
| 5,230,689 | A | | 7/1993 | Derby |
| 5,241,804 | A | | 9/1993 | Tsuruta et al. |
| 5,336,042 | A | | 8/1994 | Winski et al. |
| 5,336,417 | A | | 8/1994 | Hannum |
| 5,353,936 | A | | 10/1994 | Dockstader et al. |
| 5,354,569 | A | | 10/1994 | Brown et al. |
| 5,382,117 | A | | 1/1995 | Rings et al. |
| 5,474,111 | A | | 12/1995 | Williamson et al. |
| 5,477,658 | A | | 12/1995 | Berger et al. |
| 5,501,254 | A | | 3/1996 | Bjorklund |
| 5,507,859 | A | | 4/1996 | Kaiser |
| 5,544,472 | A | | 8/1996 | Koskinen et al. |
| 5,564,878 | A | | 10/1996 | Kay |
| 5,566,530 | A | | 10/1996 | Johnstone et al. |
| 5,567,048 | A | | 10/1996 | Hammonds |
| 5,573,044 | A | | 11/1996 | Mechalas |
| 5,598,387 | A | | 1/1997 | Pohl |
| 5,598,684 | A | | 2/1997 | Aarts |
| 5,637,183 | A | | 6/1997 | Borner |
| 5,641,057 | A | | 6/1997 | Chorlton |
| 5,651,447 | A | | 7/1997 | Huang |
| 5,678,387 | A | | 10/1997 | Aarts |
| 5,687,551 | A | | 11/1997 | Mustain et al. |
| 5,699,915 | A | | 12/1997 | Berger et al. |
| 5,701,722 | A | * | 12/1997 | Franklin et al. ..... 53/399 |
| 5,702,034 | A | | 12/1997 | Semenenko |
| 5,769,206 | A | | 6/1998 | Miyazawa et al. |
| 5,787,945 | A | | 8/1998 | Riemersma |
| 5,807,054 | A | | 9/1998 | Seymour |
| 5,809,744 | A | | 9/1998 | Villines et al. |
| 5,809,922 | A | | 9/1998 | Nelson |
| 5,848,683 | A | | 12/1998 | Seymour |
| 5,887,409 | A | | 3/1999 | Leal Pereira Da Silva |
| 5,944,455 | A | | 8/1999 | Wilhelm |
| 5,953,888 | A | | 9/1999 | Martin-Cocher et al. |
| 5,960,927 | A | | 10/1999 | Bahr |
| 5,967,579 | A | | 10/1999 | Hebert |
| RE36,467 | E | | 12/1999 | Seymour |
| 6,009,993 | A | | 1/2000 | Turcheck, Jr. |
| 6,012,266 | A | | 1/2000 | Koskinen et al. |
| 6,032,439 | A | | 3/2000 | Birkenfeld et al. |
| 6,032,786 | A | | 3/2000 | Svensson |
| 6,036,408 | A | | 3/2000 | Wilhelm et al. |
| 6,131,766 | A | | 10/2000 | King et al. |
| 6,138,723 | A | | 10/2000 | Wagner |
| 6,164,453 | A | | 12/2000 | Perkins |
| 6,178,720 | B1 | | 1/2001 | Schianchi |
| 6,205,750 | B1 | | 3/2001 | Koskinen et al. |
| D440,362 | S | | 4/2001 | Thornberg |
| 6,219,998 | B1 | | 4/2001 | Demming et al. |

| | | | |
|---|---|---|---|
| 6,254,519 | B1 | 7/2001 | Toshima |
| 6,289,636 | B1 | 9/2001 | White et al. |
| 6,299,354 | B2 | 10/2001 | Nickell et al. |
| 6,312,151 | B1 | 11/2001 | Pendleton |
| 6,324,459 | B1 | 11/2001 | Jung |
| 6,324,818 | B1 | 12/2001 | Morness et al. |
| 6,334,527 | B1 | 1/2002 | Kitamura |
| 6,343,459 | B1 | 2/2002 | Seaward et al. |
| 6,371,644 | B1 | 4/2002 | Forman |
| 6,382,108 | B1 | 5/2002 | Stanek et al. |
| 6,393,804 | B1 | 5/2002 | Ausnit |
| 6,415,927 | B1 | 7/2002 | Stone et al. |
| 6,470,654 | B1 | 10/2002 | Lachenmeier et al. |
| 6,494,324 | B2 | 12/2002 | Ours et al. |
| 6,560,947 | B2 | 5/2003 | Kasel |
| 6,575,629 | B1 | 6/2003 | Perkins |
| 6,594,970 | B1 | 7/2003 | Hyne et al. |
| 6,647,701 | B2 | 11/2003 | Rettich |
| 6,777,019 | B1 | 8/2004 | Thornberg |
| 6,843,283 | B2 | 1/2005 | Dietrich |
| 6,845,600 | B2 | 1/2005 | Hannen et al. |
| 6,865,865 | B2 | 3/2005 | Hannen et al. |
| 6,880,311 | B2 | 4/2005 | Winkler |
| 6,892,768 | B1 | 5/2005 | Ours et al. |
| 6,918,225 | B2 | 7/2005 | Ours et al. |
| 6,935,385 | B2 | 8/2005 | Ours et al. |
| 6,945,015 | B2 | 9/2005 | Ours et al. |
| 6,979,166 | B2 | 12/2005 | Ours et al. |
| 7,040,076 | B2 | 5/2006 | Lachenmeier et al. |
| 7,055,293 | B2 | 6/2006 | Ours et al. |
| 7,080,730 | B2 | 7/2006 | Ours et al. |
| 7,174,924 | B2 | 2/2007 | Ours et al. |
| 7,284,360 | B2 | 10/2007 | Cary et al. |
| 7,536,840 | B2 | 5/2009 | Ours et al. |
| 2001/0008567 | A1 | 7/2001 | Burkhardt |
| 2001/0029722 | A1 | 10/2001 | Ours et al. |
| 2002/0130016 | A1 | 9/2002 | Scholz |
| 2002/0191869 | A1 | 12/2002 | Stewart et al. |
| 2003/0038055 | A1 | 2/2003 | Ours et al. |
| 2003/0057129 | A1 | 3/2003 | Ours et al. |
| 2004/0081374 | A1 | 4/2004 | Richardson, Jr. et al. |
| 2005/0126126 | A1 | 6/2005 | Ours et al. |
| 2005/0204709 | A1 | 9/2005 | Berger et al. |
| 2006/0037285 | A1 | 2/2006 | Cary et al. |
| 2006/0151059 | A1 | 7/2006 | Ours et al. |
| 2006/0185327 | A1 | 8/2006 | Ours et al. |
| 2009/0223179 | A1* | 9/2009 | Johnstone ..... 53/562 |

FOREIGN PATENT DOCUMENTS

| | | | |
|---|---|---|---|
| DE | 621624 | | 11/1935 |
| DE | 3006623 | A1 | 8/1981 |
| DE | 3340322 | A1 | 5/1985 |
| DE | 4124911 | | 1/1993 |
| DE | 4439970 | A1 | 5/1996 |
| DE | 29503132 | U1 | 7/1996 |
| EP | 0122864 | A1 | 10/1984 |
| EP | 0765829 | A1 | 4/1997 |
| EP | 0922640 | A1 | 6/1999 |
| EP | 0943560 | A1 | 9/1999 |
| FR | 2600973 | | 1/1988 |

OTHER PUBLICATIONS

Partial International Search Report, 3 pages , for PCT/US2009/046351.

* cited by examiner

UNITARY TRANSPORTER BASE AND SHAPER AND SLIP FRAME FORMER FOR FORMING A TRANSPORTABLE CONTAINER

CROSS REFERENCE TO RELATED APPLICATION

This application claims the benefit of U.S. Provisional Patent Application Ser. No. 61/059,027 for a UNITARY TRANSPORTER BASE AND SHARPER AND SLIP FRAME FORMER FOR FORMING A TRANSPORTABLE CONTAINER, filed on Jun. 5, 2008, which is hereby incorporated by reference in its entirety.

BACKGROUND OF THE INVENTION

1. Field of the Invention

The subject invention relates to a transportable container for flowable bulk goods, and more particularly, a method of forming and shaping a transportable container with a unitary transport base and slip frame former.

2. Description of the Prior Art

Typical containers utilized for transport of bulk particulate fill material are inefficient, do not have a very large volume, and often require a large amount of manual labor to fill and handle of these containers.

U.S. Pat. No. 1,590,086 to Day et al. discloses a packer having a moveable cage for surrounding a container of bulk goods. The cage moves between an open position and a packing position. When in the packing position, bulk goods are fed into the container and take the shape of the cage. When the container is filled, the cage moves to an open position to allow access to the container of bulk goods. The cage in the Day patent is a two-piece cage that surrounds the container when in the packing position.

U.S. Pat. No. 2,676,739 to Nettekoven et al. discloses a bag filling machine having a platform carrying a jacket or cage to surround a container of bulk goods and prevent the container of bulk goods from bursting while being packed. The jacket moves downwardly with the platform as bulk goods are disposed in the container. The weight of the bulk goods in the container cause the platform and jacket to move downwardly.

U.S. Pat. No. 1,649,362 to Nagel discloses a method of compressing loose material in elastic containers. The Nagel patent discloses using a pair of compressing members to exert a downwardly directed wiping pressure on opposite sides of the container U.S. Pat. No. 3,944,070 to Cardwell et al. discloses a package having a plastic pallet with a load of articles disposed on the pallet and a layer of shrinkable thermoplastic film wrapped around the pallet and goods. The Cardwell patent discloses a system where a plurality of articles, such as bags, are stacked in several layers on the pallet. A layer of shrink film is then wrapped about the loaded pallet to stabilize the package.

U.S. Pat. No. 4,930,632 to Eckert et al. discloses a containment tray formed of plastic for storing hazardous liquids. The containment tray includes upright perimeter walls that define a containment area. The bottom wall has a plurality of transverse channels for receiving fork lift arms. A platform member is placed in the containment tray and the height of the platform member is sufficient whereby the planar platform at its upper edge is supported vertically above the upper edges of the side walls of the containment tray. The platform provides the base for receiving and supporting palletized loads of hazardous chemicals.

U.S. Pat. No. 4,234,273 to Handleman et al. discloses a container for transporting, storing, and unloading a load of fluidizable material. The container has a continuous, outwardly projecting flange. A tubular bag is disposed over the flange and a hoop clamp is used to secure the tubular bag to the pallet. The pallet has legs spaced to receive the lifting tines of a lifting device. A vent valve is provided for maintaining pressure within the container during fluidization of the load within a predetermined pressure range to maintain shape and structure while the container is being unloaded without limiting the flow of fluidizing air but preventing excessive pressure from being applied to the bag.

SUMMARY OF THE INVENTION AND ADVANTAGES

The present invention relates to a method of producing a transportable container for bulk goods. A bag with an open top and a closed base is placed through a former opening that is defined by a slip frame former having at least one wall. The slip frame former surrounds a portion of the bag. The closed base of the bag is disposed adjacent a bottom support or transporter base and the open top of the bag is disposed adjacent a feed source. The bag is filled with bulk goods from the feed source through the open top. A stretch wrap from a stretch wrapping device is disposed radially about the bottom support and a portion of the at least one former wall to initially form the transportable container. A fill sensor monitors the fill level of the bulk goods in the bag. At least one of the slip frame former and the bottom support moves vertically relative to other of the slip frame former and the bottom support in response to the fill level of the bulk goods as determined by the fill sensor. As the slip frame former and the bottom support move relative to each other, the filled portion of the bag is exposed between the slip frame former and the bottom support. During filling, the slip frame former is maintained at a position to surround the fill level of the bulk goods in the bag. As the fill level increases in the bag, previously disposed portions of stretch wrap are disengaged from the slip frame former to squeeze the filled portions of the bag and lock together the bulk goods disposed in the bag. Additional portions of stretch wrap are disposed around a portion of the at least one wall of the slip frame former to maintain the transportable container for receiving bulk goods as the previously disposed portions of stretch wrap are disengaged from the at least one wall of the slip frame former.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
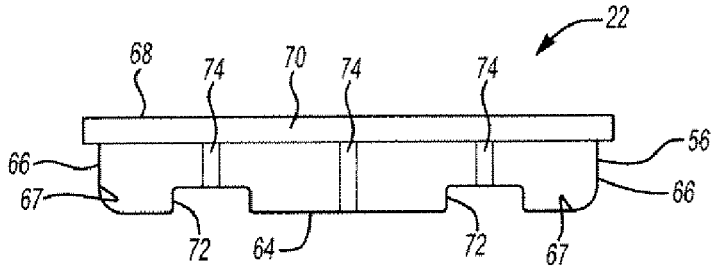
FIG. 1 is side view of an exemplary transporter base of the present invention.
Figure 2:
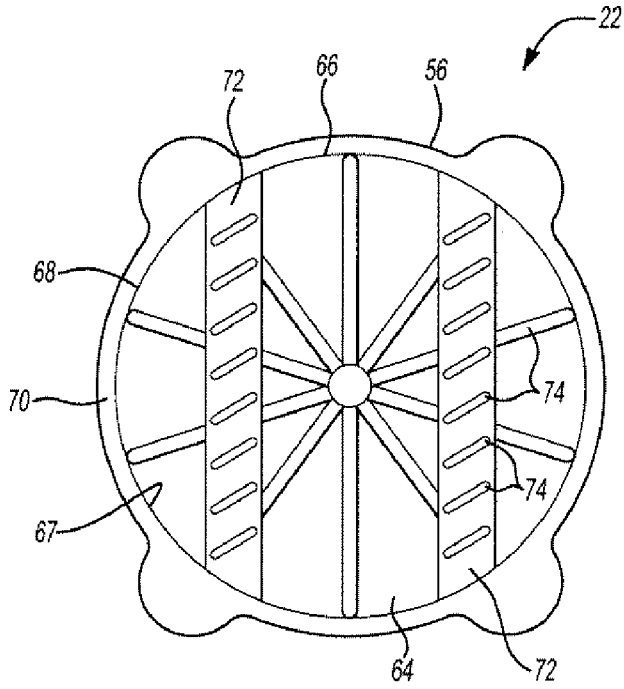
FIG. 2 is a plan view of the exemplary transporter base as shown in FIG. 1.
Figure 3:
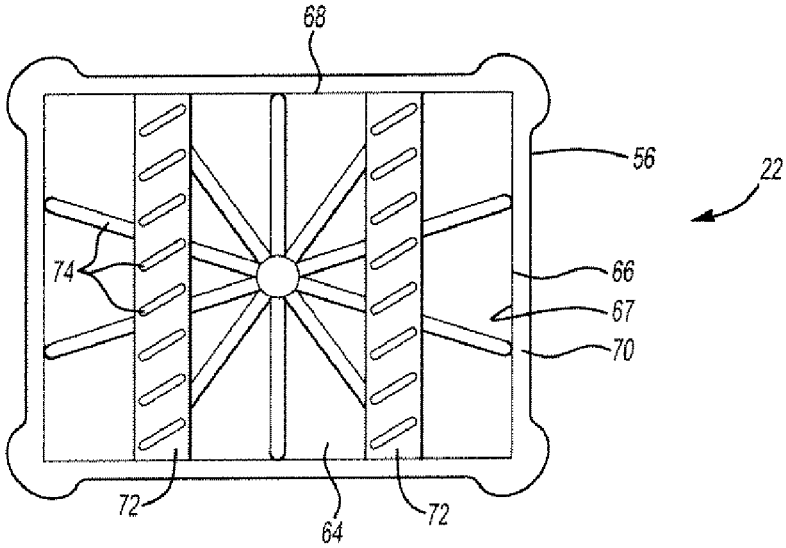
FIG. 3 is a plan view of another exemplary transporter base of the present invention.
Figure 4:
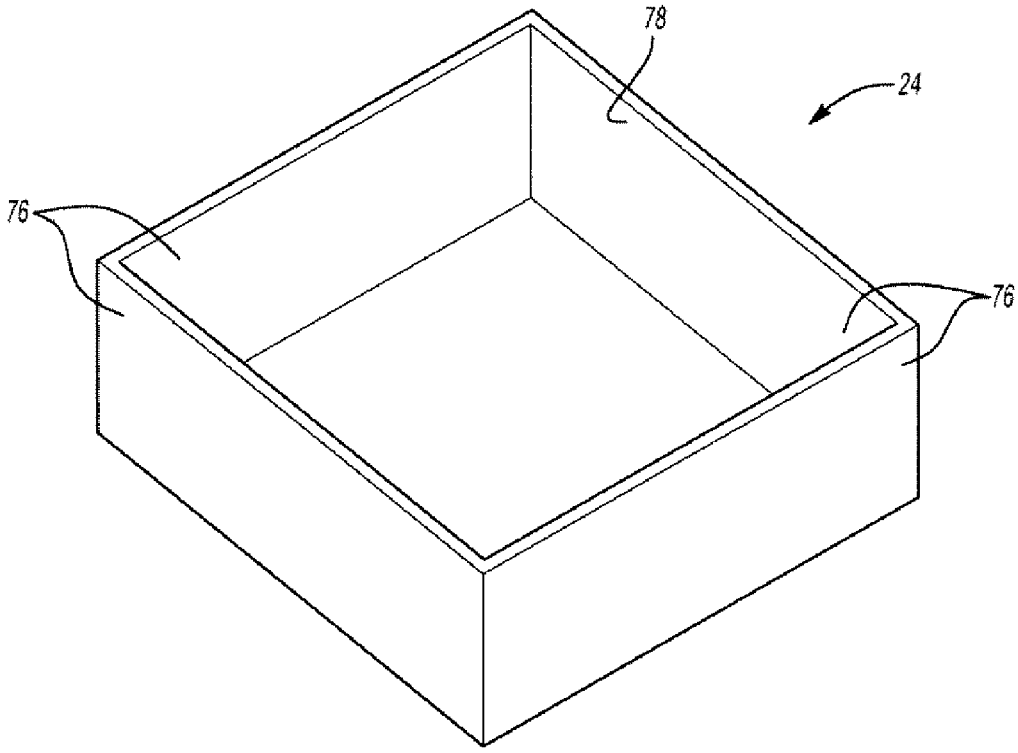
FIG. 4 is a perspective view of an exemplary slip frame former of the present invention.
Figure 5:
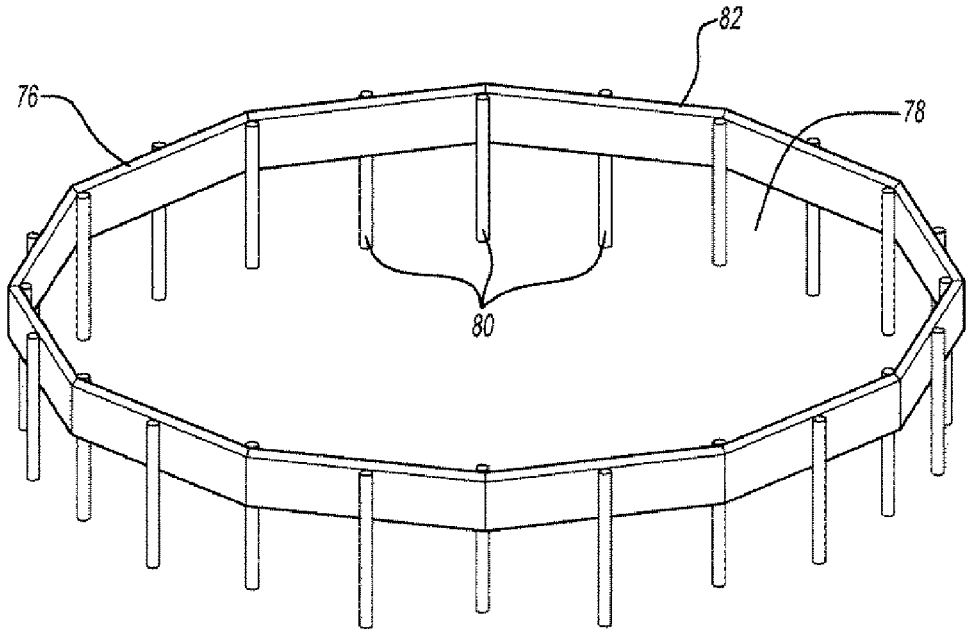
FIG. 5 is a is perspective view of another exemplary slip frame former of the present invention.
Figure 6:
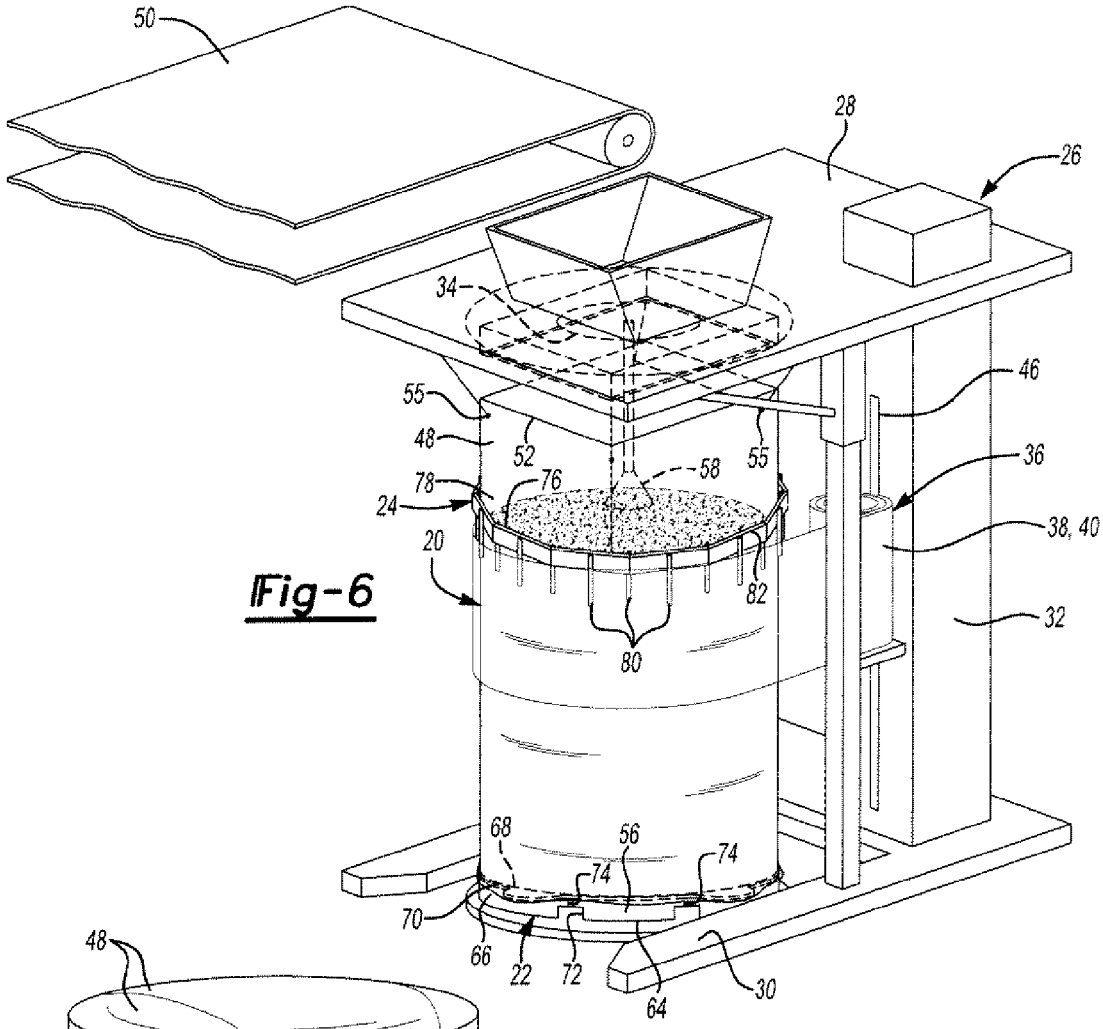
FIG. 6 is a perspective view of an exemplary packaging system according to the present invention using a slip frame former and transporter base.
Figure 7:
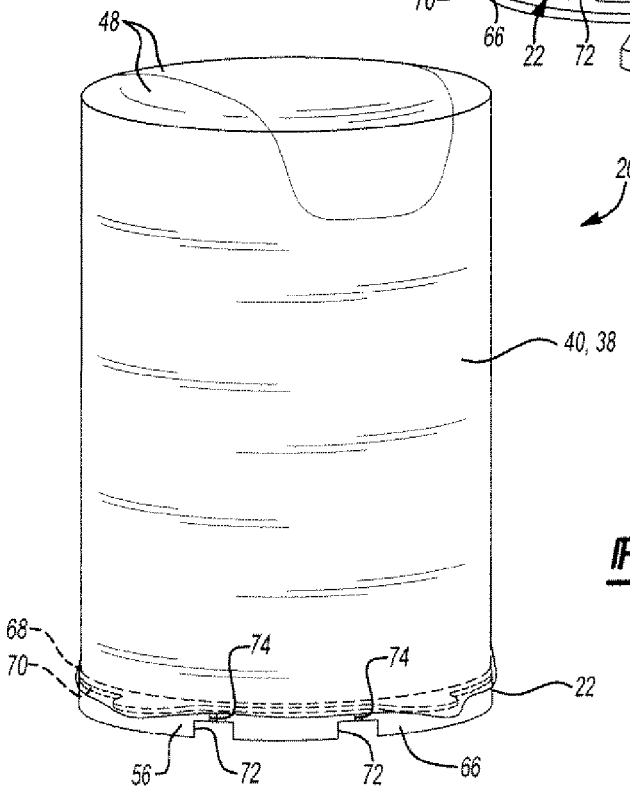
FIG. 7 is perspective view of a transportable container produced from the packaging system as shown in FIG. 6.
Figure 8:
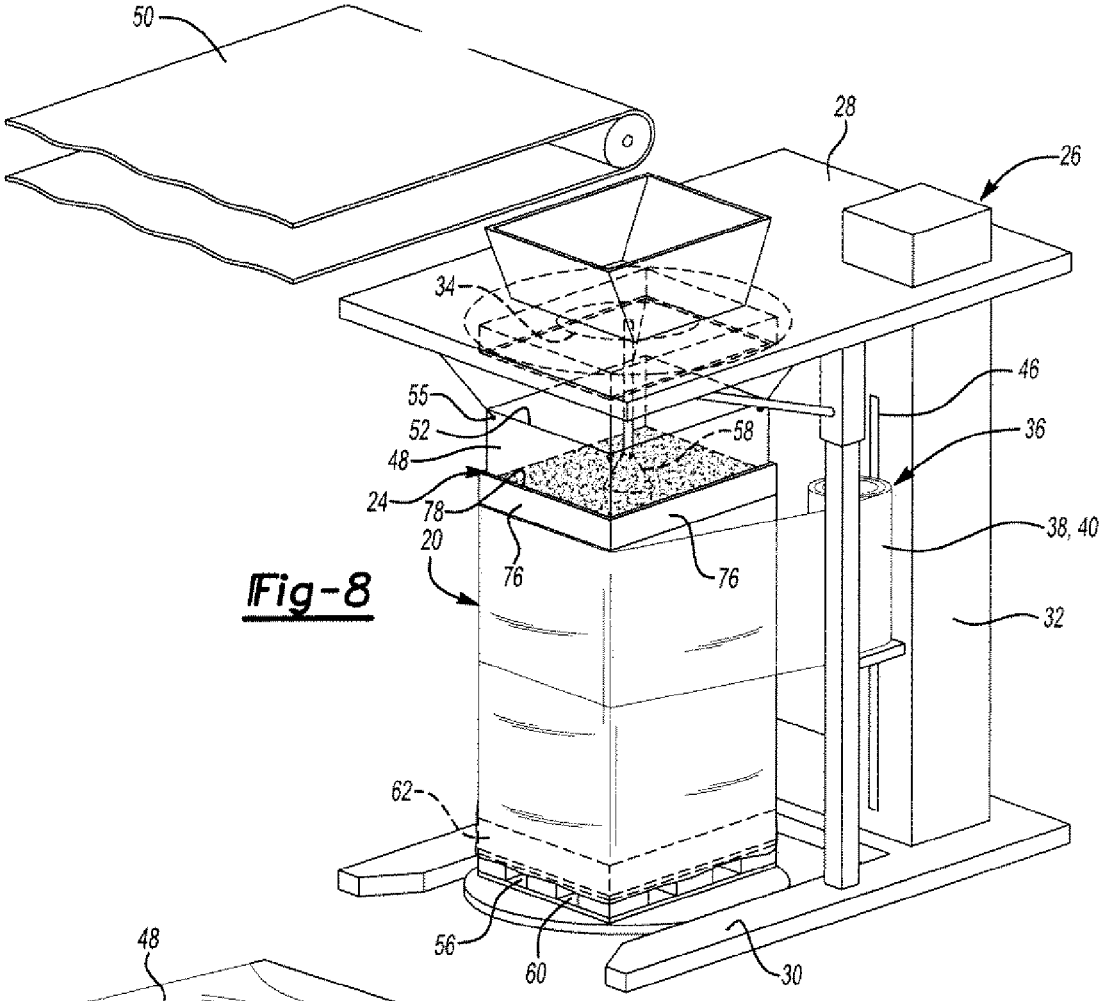
FIG. 8 is a perspective view of an exemplary packaging system according to the present invention using a pallet with slip sheet and a slip frame former.
Figure 9:
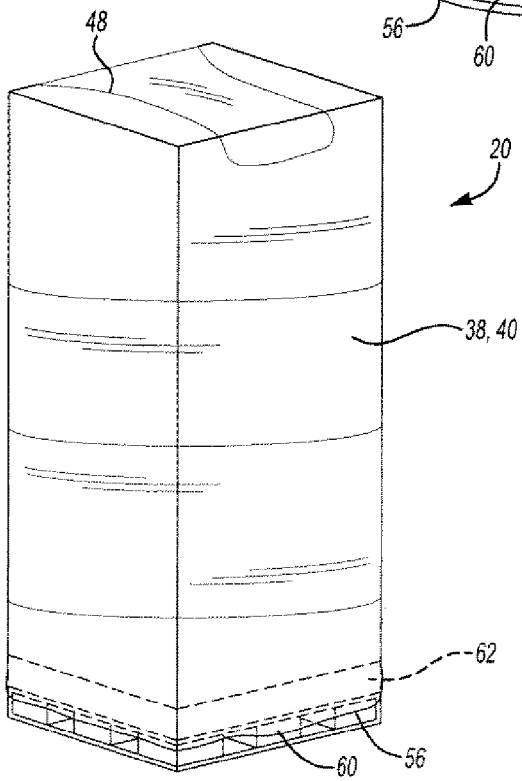
FIG. 9 is perspective view of a transportable container produced from the packaging system as shown in FIG. 8.
Figure 10:
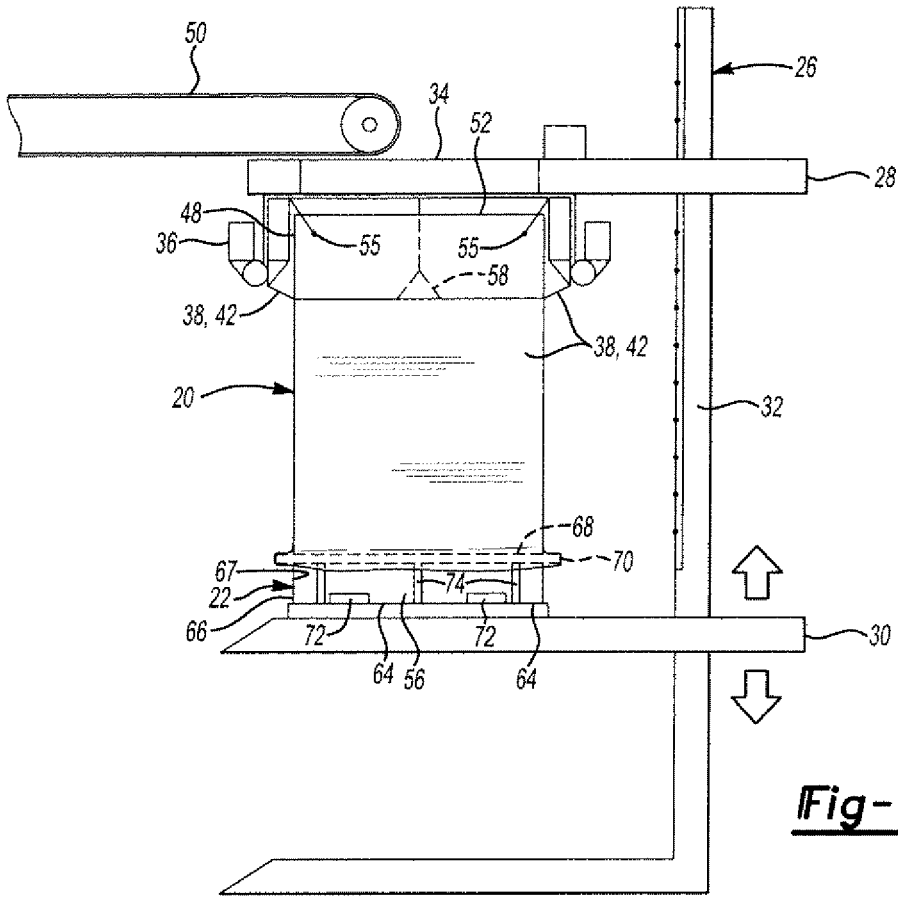
FIG. 10 is a side view of an exemplary packaging system according to the present invention using a slip frame former and transporter base.
Figure 11:
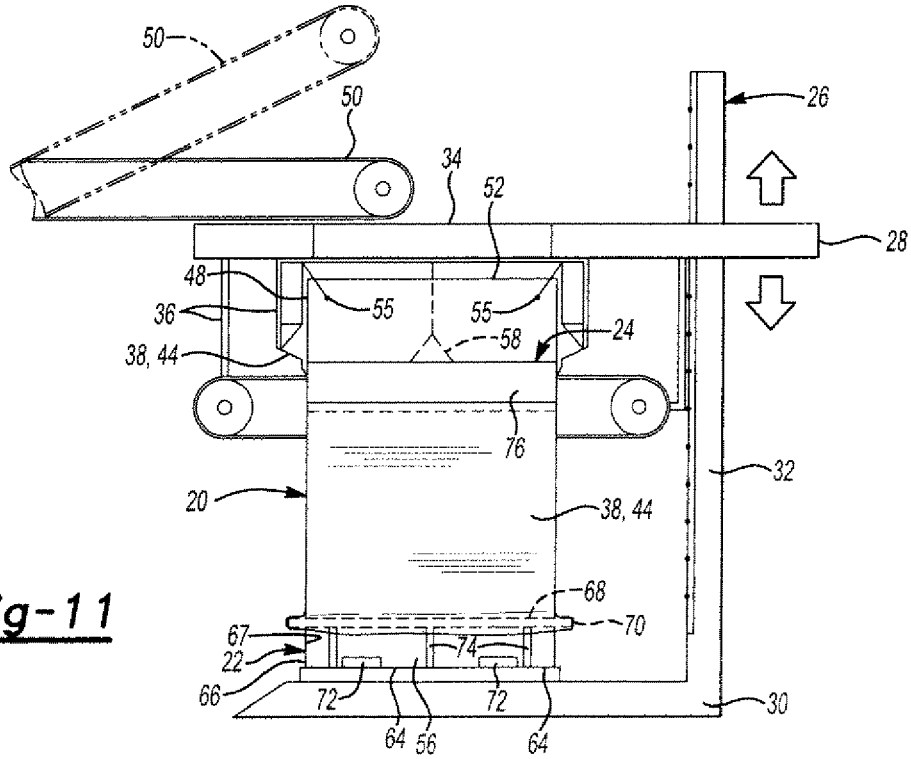
FIG. 11 is a side view of an exemplary packaging system according to the present invention using only a transporter base.
Figure 12:
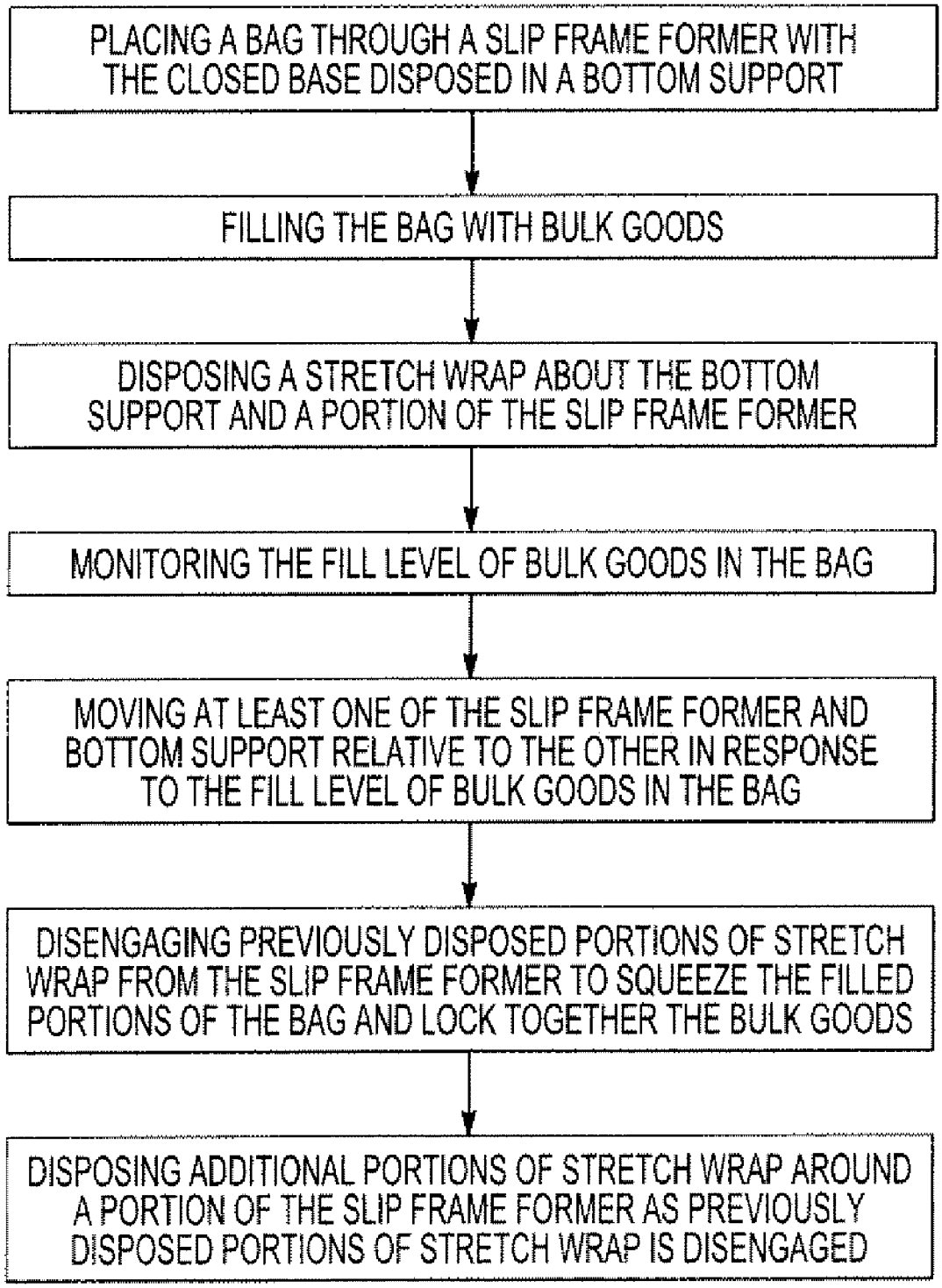
FIG. 12 is a flow chart showing an exemplary method of forming a transportable container according to the present invention.
Figure 13:
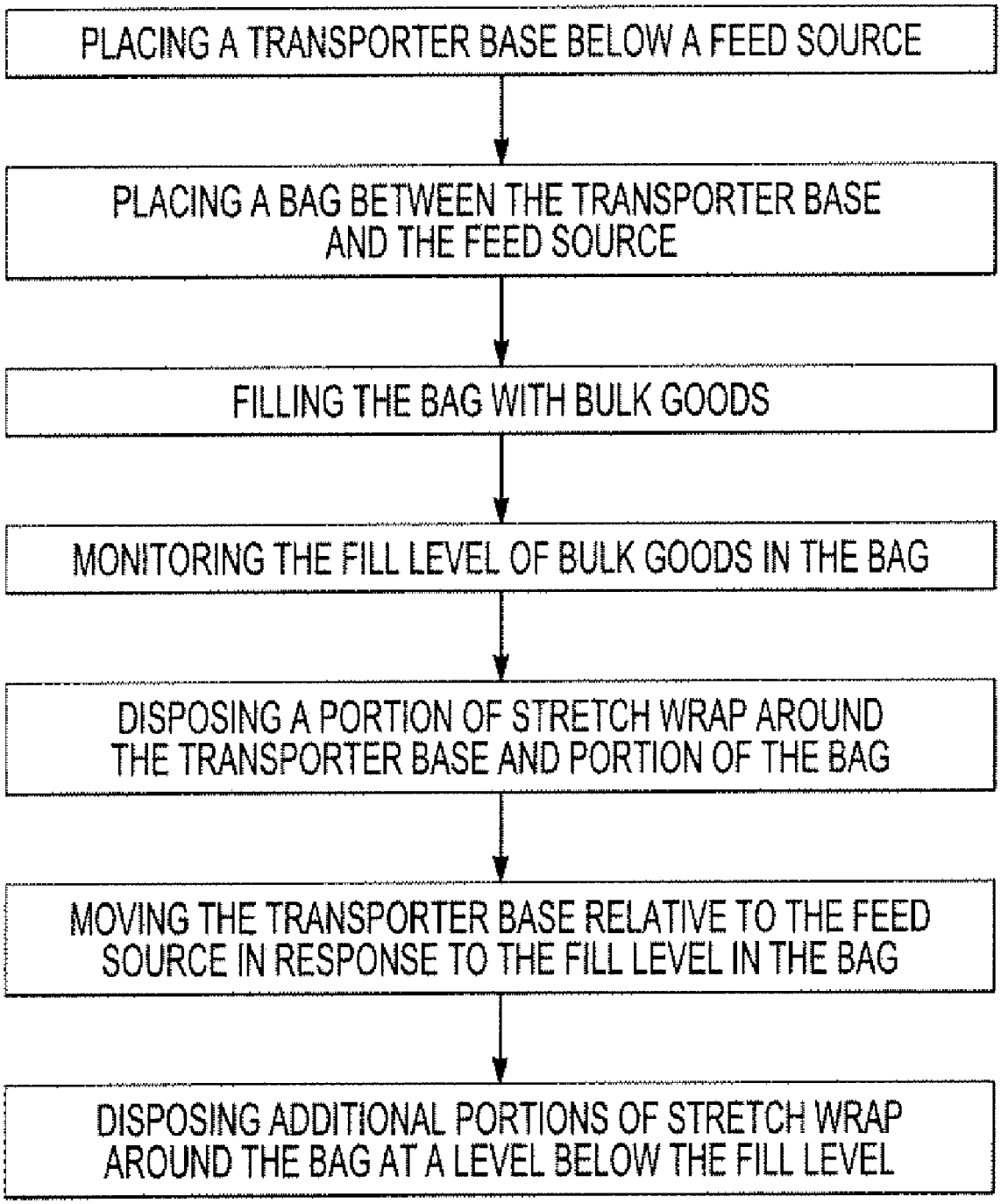
FIG. 13 is a flow chart showing another exemplary method of forming a transportable container according to the present invention.

Throughout the present specification and claims the phrase "bulk goods" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller bulk goods include, but are not limited to, the following: agricultural products like seeds, rice, grains, vegetables, fruits, chemical products like fine chemicals, pharmaceuticals, raw chemicals, fertilizers, plastics like plastic resin pellets, plastic parts, rejected plastic parts, machined plastic parts, cereals and cereal products such as wheat, a variety of machined parts of all sorts, wood products like wood chips, landscaping material, peat moss, dirt, sand, gravel, rocks and cement. The present invention also finds utilization in bulk packaging of larger bulk goods including, but not limited to: prepared foods, partially processed foods like frozen fish, frozen chicken, other frozen meats and meat products, manufactured items like textiles, clothing, footwear, toys like plastic toys, plastic half parts, metallic parts, soft toys, stuffed animals, and other toys and toy products. All of these types of materials and similar bulk packaged materials are intended to be encompassed in the present specification and claims by this phrase.

Referring to the Figures, wherein like numerals indicate corresponding parts throughout the several views, a transportable container 20 for flowable bulk goods formed and shaped by a unitary transporter base 22 and a slip frame former 24 and a method to make the same are generally shown.

While the unitary transporter base 22 and slip frame former 24 may be adapted to work with any number of packaging systems 26, the exemplary embodiment of the present invention will be explained in reference to the exemplary packaging system 26 discussed below. In the exemplary embodiment, the packaging system 26 includes a frame having an upper support 28 spaced from a frame base 30. At least one support column 32 extends between the frame base 30 and upper support 28. The upper support 28, the frame base 30, or both may be vertically movable along the support column 32. The upper support 28 defines a support opening 34 through which bulk goods may be fed.

An upper turntable may be mounted within the upper support 28 of the packaging system 26. A lower turntable may be mounted within the frame base 30 of the packaging system 26. The lower turntable and upper turntable may be stationary or rotatable. The rotation of the lower and upper turntables may be synchronized such that they rotate in unison. The synchronized rotation of the of the upper and lower turntables allows for the even distribution of bulk goods. The packaging system 26 may comprise a conventional stretch wrapping device 36 for applying a stretch wrap 38 to the transportable container 20. The stretch wrap 38 can be any stretch wrap 38 known in the art, including but not limited to a roll of outer wrap 40, a stretch bag 42, and a heat shrink film 44. In the exemplary embodiment, the stretch wrapping device 36 includes a wrap head having a roll of outer wrap 40 secured on a wrap head base. The outer wrap 40 is preferably a wrap having a high cling factor, but the outer wrap 40 may be any of a variety of stretch wrap films known in the art. The wrap head is vertically moveable along a guide rod 46 that runs parallel to the support column 32, and may be moved up and down the guide rod 46 by a motor or any other mechanism known in the art. The wrap head may also be movable radially about the packaging system 26. In this embodiment, the transportable container 20 that is position between the frame base 30 and upper support 28 is stationary and the wrap head is moveable both in a vertically and radially about the transportable container 20 to apply the outer wrap 40 radially about the transportable container 20.

A flexible bag 48 is disposed between the upper support 28 and the frame base 30 to receive bulk goods from a feed source 50. The flexible bag 48 includes an open top 52 and a closed base 54. In the exemplary embodiment, the open top 52 is secured in an open position adjacent the support opening 34 of the upper support 28 and the feed source 50, and the closed base 54 is positioned adjacent the frame base 30. The bulk goods are fed from the feed source 50 through the support opening 34 and into the open top 52 of the flexible bag 48 to form the transportable container 20. The feed source 50 may be a conveyor, hopper or any other feed source 50 known in the art.

The closed base 54 can be formed into the bag 48 or the bag 48 can be a continuous tubular roll wherein the closed base 54 is formed by folding over the tubular roll or bunching the tubular roll up. In addition, the continuous tubular roll may also form the closed base 54 by twisting and tying off a length of the tubular roll which later could be used as a pour spout during subsequent unloading of the bulk goods. The bag 48 is preferably a gusseted bag 48 and can be formed from any food grade material such as for example, low density polyethylene, high density polyethylene, a food grade polymer, nylon, or any other food grade material known in the art.

The flexible bag 48 is secured between the upper support 28 and the frame base 30. In an exemplary embodiment, bag clips 55 extend downwardly from the upper support 28 and attach to the bag 48 at a position of approximately 50 to 100 inches down from the open top 52. Sufficient length is left to allow the open top 52 of the bag 48 to be moved into a folded over position so that the bag 48 can be sealed with an outer wrap 40 after the bulk goods have been added to the bag 48. In this particular embodiment, the bag 48 is in a standing position with the open top 52 being secured adjacent to the support opening 34 of the upper support 28, while the closed base 54 is vertically spaced from the open top 52 and positioned adjacent to the frame base 30 in a bottom support 56. As the bag 48 is filled an outer wrap 40 is spirally wrapped around bag 48 at a level slightly below the fill level in the bag 48 to form the transportable container 20.

In alternative embodiment, the bag 48 is held in a bunched manner adjacent the upper support 28. The bulk goods are fed into the open top 52 of the bag 48 using an articulated feed source 50. As the bag 48 is filled, the outer wrap 40 is spirally wrapped around bag 48 at a level slightly below the fill level in the bag 48 to form the transportable container 20, and the upper support 28 is moved vertically in an upward direction as is the end of the articulated feed source 50. The upper support 28 may be moved by a gear mechanism or other mechanism known in the art.

In another alternative embodiment, the frame base 30 and bottom support 56 disposed thereon are vertically movable. In this embodiment, during the initial stages of filling the bag 48, the bottom support 56 is placed at a position adjacent the upper support 28. As the bag 48 fills, the bottom support 56 is moved in a downward direction to accommodate additional bulk goods. The advantage of this packaging system 26 is that fragile materials have a lower distance to drop from feed source 50 into bag 48. Movement of the frame base 30 can be accomplished by any of a variety of mechanisms including scissors platform legs, hydraulic pistons, pneumatic pistons, a geared mechanism, or any other mechanism known in the art.

The packaging system 26 may include a fill sensor 58 to monitor the level of bulk goods in the bag 48. The fill sensor 58 may be an ultrasonic transmitter and receiver, or any other sensor known in the art. Based on the level of bulk goods in the transportable container 20, as determined by the fill sensor 58, the upper support 28 or frame base 30 is moved to accommodate additional bulk goods. In addition, based on the level of bulk goods in the transportable container 20, as determined by the fill sensor 58, the stretch wrapping device 36 is controlled to apply the outer wrap 40 to the transportable container 20.

The closed base 54 of the bag 48 is placed in the bottom support 56. The bottom support 56 may be a pallet 60 and slip sheet 62, or any other support device known in the art. In the exemplary embodiment, the bottom support 56 is a unitary transporter base 22 and the closed base 54 of the bag 48 is placed in the unitary transporter base 22. The unitary transporter base 22 is disposed on the frame base 30 below the feed source 50. The transporter base 22 is made of molded plastic, but may be manufactured by any process known in the art and made of any other material known in the art. The transporter base 22 may be round, square or any other shape known in the art. The shape of the transportable container 20 is determined by the shape of the transporter base 22. For example, a round transporter base 22 will produce a round transportable container 20 while a square transporter base 22 will produce a square transportable container 20.

While any shape transporter base 22 may be used, the square transporter base 22, which results in a square transportable container 20, is the preferred shape. The square transportable container 20 allows for the greatest amount of space to be utilized when a plurality of transportable containers 20 are placed next to one another in a shipping truck. The round transporter base 22, which results in a round transportable container 20, will lead to a void or wasted space being present when the round transportable containers 20 are placed next to one another in a shipping truck.

The transporter base 22 has a bottom 64 and at least one wall 66 that extends peripherally from the bottom 64 to a wall end 68. The at least one wall 66 defines a shaping area 67 that assists in the initial shaping of the transportable container 20. A plurality of ears extend radially outward from the wall end 68 to create an outer edge or lip 70. The ears maintain the position of the outer wrap 40 with respect to the transporter base 22. As bulk goods are added to the bag 48 in the transporter base 22, the outer wrap 40 is secured to the transporter base 22 by wrapping the outer wrap 40 around the transporter base 22. As the level of bulk goods in bag 48 increases, the outer wrap 40 in spirally wrapped by the stretch wrapping device 36 at a predetermined level below the level of bulk goods.

In the exemplary embodiment, the bottom 64 of the transporter base 22 has a diameter or width at about 48 inches, and the wall 66 has a height at about 8 inches. These dimensions are just exemplary and transporter base 22 may have any shape, diameter, width or height. The diameter or width and height may be adjusted based on the desired shape and size of the transportable container 20.

The transporter base 22 includes at least one pair of recesses 72 extending upwardly from the bottom 64 of the transporter base 22 so that a fork lift can pickup and move the transportable container 20 of bulks goods In the exemplary embodiment, the least one pair of recesses 72 are molded into the transporter base 22. The recesses 72 are engage by the tines of a transporting device, and transporting device transports the transportable container 20 away from the feed source 50.

The transporter base 22 may further include a plurality of inwardly extending notches 74. The notches 74 extend inwardly from the inner surface of the bottom 64 and wall 66 of the transporter base 22. The notches 74 present an uneven surface on the inner surface of the transporter base 22 so that the bulk goods will not conform directly to the inner surface of the transporter base 22, which may be problematic in removing the bulk goods from the transporter base 22.

The bag 48 is placed between the transporter base 22 and the feed source 50. The closed bottom 64 of the bag 48 is disposed within the shaping area 67 of the transporter base 22 and the open top 52 of the bag 48 is disposed adjacent the feed source 50. The bag 48 is fed through the open top 52 from the feed source 50 with bulk goods. The bulk goods will initially conform to the shape of the shaping area 67. As bulk goods are added to the bag 48, the shaping area 67, as defined by the walls 66 of the transporter base 22, will initially shape the transportable container 20. As the level of bulk goods rises, the outer wrap 40 is spirally wrapped by the stretch wrapping device 36 at a predetermined level below the bulk goods. The bulk goods will want to maintain the initial shape of the transporter base 22. In the past, transportable containers 20 have been placed on and secured to a pallet 60 and included a slip sheet 62. The pallet 60 which rests on the lower turntable during filling of the transportable container 20, allows for a fork lift to pick up and transport the transportable container 20 as needed. Pallets 60 are heavy and require space in shipping trucks. Typically, pallets 60 weigh 70 pounds or more and have a standard surface dimensions of 40 inches by 48 inches and require 6 inches of height. The transporter base 22 allows for the bulk goods to be more effectively packaged and formed into the transportable containers 20 and then shipped.

In summary, the bulk goods will initially conform to the shape of the shaping area 67. As bulk goods are added to the bag 48, the shaping area 67 as defined by the walls 66 of the transporter base 22 will initially form and shape the transportable container 20. The fill level of the bulk goods in the bag 48 are monitored by a fill senor while filling the bag 48. A portion of stretch wrap 38 is disposed around the wall 66 and the radially extending lip 70 of the transporter base 22, and a portion of the bag 48 at a level below the fill level of bulk goods in the bag 48. As the bag 48 is filled with bulk goods, the transporter base 22 moves vertically relative to the feed source 50 in response to the fill level of the bulk goods in the bag 48. In an exemplary embodiment, the feed source 50 moves upwardly relative to the stationary transporter base 22 in response to the fill level of the bulk goods in the bag 48. In another embodiment, the transporter base 22 moves downwardly relative to the stationary feed source 50 in response to the fill level of the bulk goods in the bag 48. As the bag 48 is filled with bulk goods, additional portions of stretch wrap 38 are disposed around the bag 48. The stretch wrap 38 is maintained at a level below the fill level of the bulk goods to maintain the shape of the transporter base 22 and to squeeze the bag 48 and lock together the bulk goods disposed in the bag 48. The transporter base 22 initially shapes the bulk goods and the stretch wrap 38 will maintain the shape of the transporter base 22 as the level of bulk goods in the bag 48 increases. In the exemplary embodiment, the stretch wrap 38 is an outer wrap 40 from a stretch wrap 38 roll that is disposed spirally about the transporter base 22 and the bag 48, but any stretch wrap 38 known in the art, including but not limited to a stretch bag 42 and heat shrink film 44, may be used.

The exemplary embodiment further includes a slip frame former 24 for shaping and forming the transportable container 20. The slip frame former 24 is chosen based on the desired shape of the transportable container 20 and may be round, square or any other shape known in the art. The shape of the transportable container 20 is determined by the shape of the slip frame former 24. For example, a round slip frame former 24 will produce a round transportable container 20 while a square slip frame former 24 will produce a square transportable container 20.

In the exemplary embodiment, the slip frame former 24 includes at least one former wall 76 having an outer surface that defines a former opening 78. The former walls 76 are from about 6 to 15 inches in height and may be made from metal, plastic, or any other material known in the art. The former walls 76 are configured such that the former opening 78 is the desired shape in which the transportable container 20 will be formed into. For example, when a square shaped transportable base is desired, the slip frame former 24 includes former walls 76 that are secured to one another to define the square shaped opening. When a circular shaped transportable base is desired, the slip frame former 24 includes a continuous former wall 76 that is shaped to define a circular shaped opening. In the exemplary embodiment, the former walls 76 have a continuous outer surface that extends from the bottom of the slip frame former 24 to the top of the slip frame former 24.

The slip frame former 24 may be used with the pallet 60 and slip sheet 62, or it may be used in addition to the transporter base 22. When the slip frame former 24 is used with the transporter base 22, the slip frame former 24 will typically be the same shape as the transporter base 22 so as to hold the desired shape of the transporter base 22 in forming the transportable container 20. In an exemplary embodiment, the slip frame former 24 includes one continuous former wall 76, the transporter base 22 includes one continuous wall 66, and the shape of the former opening 78 defined by the one continuous former wall 76 and the shaping area 67 defined by the one continuous wall 66 of transporter base 22 are circular. In another exemplary embodiment, the slip frame former 24 includes a plurality of former walls 76, the transporter base 22 includes a plurality of walls 66, and the shape of the former opening 78 defined by the former walls 76 and the shaping area 67 defined by the walls 66 of the transporter base 22 are square.

The slip frame former 24 is placed vertically above the transporter base 22 prior to placing the bag 48 through a former opening 78. The slip frame former 24 includes at least one former wall 76 that defines the former opening 78 and is placed vertically above the transporter base 22. The transporter base 22 includes the bottom 64 that defines the periphery and the at least one wall 66 that extends upwardly from the periphery to define the shaping area 67. While the shape of the slip frame former 24 and the bottom support 56 can be different, the shape of the former opening 78 corresponds to the shape of the shaping area 67 in the exemplary embodiment. The stretch wrap 38 from the stretch wrapping device 36 is disposed radially about the bottom support 56 and a portion of the at least one former wall 76 of the slip frame former 24 to initially form the transportable container 20.

The slip frame former 24 is secured to the upper support 28. The slip frame former 24 retains its position relative to the level of bulk goods in the transportable container 20 as the level of bulk goods moves upwardly during filling of the bag 48 to form the transportable container 20. In the exemplary embodiment the slip frame former 24 moves upwardly with upper support 28 as the level of bulk goods moves upwardly during filling of the bag 48 to form the transportable container 20. In another exemplary embodiment, the slip frame former 24 is secured to the upper support 28 and remains stationary as the frame base 30 move vertically downward. As the bag 48 fills, the frame base 30 is moved in a downward direction to accommodate additional bulk goods and as such, the level of bulk goods remains constant relative to the slip frame.

In the exemplary embodiment, the stretch wrap 38 is an outer wrap 40 that is applied from a stretch wrap 38 roll spirally about the bottom support 56 and a portion of the at least one former wall 76 of the slip frame former 24. Additional portions of the outer wrap 40 are spirally disposed about a portion of the at least one wall 66 of the slip frame former 24 to maintain the shape of the transportable container 20 as previously disposed portions of outer wrap 40 are disengaged from the at least one wall 66 of the slip frame former 24.

The outer wrap 40 that is used to secure the transportable container 20 overlaps the outer surface of the slip frame former 24 so as to maintain the shape of the slip frame former 24. The outer surface of the slip frame former 24 may be altered to allow for the slip frame former 24 to be easily pulled away from the outer wrap 40 as the level of bulk goods in the transportable container 20 increases. The outer surface of the slip frame former 24, particularly the corners of the former walls 76 or the downwardly extending arms 80, may be altered by a Teflon coating, a dimpled surface, or any other method known in the art for decreasing the amount of friction between the slip frame former 24 and outer wrap 40. In an alternative embodiment, the former walls 76 include a former base 82 having arms 80 extending downwardly from the former base 82. This embodiment decreases the outer surface of the slip frame former 24 and decreases the amount of fiction between the slip frame former 24 and the outer wrap 40.

At least one of the slip frame former 24 and the bottom support 56 moves vertically relative to other of the slip frame former 24 and the bottom support 56 in response to the fill level of the bulk goods in the bag 48. This movement exposes the filled portion of the bag 48 between the slip frame former 24 and the bottom support 56 as the bag 48 is filled with bulk goods. In an exemplary embodiment, the slip frame former 24 moves vertically upward relative to the stationary bottom support 56 in response to the fill level of the bulk goods in the bag 48. In alternative exemplary embodiment, the bottom support 56 moves vertically downward relative to the stationary slip frame former 24 in response to fill level of the bulk good in the bag. The slip frame former 24 is maintained in a position that surrounds the fill level of the bulk goods in the bag 48. Previously disposed portions of stretch wrap 38 are disengaged from the slip frame former 24 to squeeze the filled portions of the bag 48 and lock together the bulk goods disposed in the bag 48 as the slip frame former 24 moves relative to the bottom support 56. Additional portions of stretch wrap 38 are disposed around a portion of the slip frame former 24 to maintain the transportable container 20 for receiving bulk goods as previously disposed portions of stretch wrap 38 disengage the at least one wall 66 of the slip frame former 24.

The outer wrap 40 generates hoop forces which apply a gentle squeeze to the bulk goods, helping to support and firm them. The hoop forces stabilize the bulk goods by promoting controllable contact between the elements of the bulk goods being loaded into the bag 48 of the transportable container 20, thereby promoting bridging between the components of the bulk goods. For example, when the bulk goods being loaded are a bulk cereal in puff or flake form, hoop forces promote bridging between cereal pieces, thereby reducing the relative motion between the pieces and immobilizing the cereal within the bag 48. By adjusting the extent to which the outer wrap 40 is applied to the bag 48, hoop forces can be tailored to the type of bulk goods being inserted in the transportable container 20. Hoop forces allow for a very compact and rigid transportable container 20, which does not allow the bulk goods to shift or get crushed within the transportable container 20.

The transportable container 20 can be closed or left open depending on bulk goods. For example, certain bulk goods such as wood chips, sand, gravel, and other bulk goods, may not require that the transportable container 20 be closed. In such instances, the outer wrap 40 would be applied around the bulk goods in an upward direction to secure bulk goods and create the transportable container 20. Alternatively, the transportable container 20 may be closed in any of a variety of manners known in the art including, but not limited to: sonic or heat welding of the top of the transportable container 20, closure of the top of the top of the transportable container 20 by folding over the bag 48 and securing it with at least one additional layer of outer wrap 40, closure of the top of the transportable container 20 with a plastic pull tie, closure of the top of the transportable container 20 with wire or rope, closure of the top of the transportable container 20 with a clamp, and other closure means known in the art.

The transportable container 20 may further be closed by placing a transporter base 22, a slip sheet 62, or a flat sheet of cardboard or plastic on the top of the transportable container 20. After placement of the transporter base 22, slip sheet 62 or flat sheet on the top of the transportable container 20, the transportable container 20 is wrapped with additional outer wrap 40 to secure the transporter base 22, slip sheet 62 or flat sheet on the top of transportable container 20.

In an alternative embodiment, the stretch wrapping device 36 may apply a stretch tube or stretch bag 42 in place of the outer wrap 40 to form the transportable container 20. The stretch bag 42 is preferably a stretch wrap 38 having a high cling factors but the stretch bag 42 may be any of a variety of stretch wrap 38 films known in the art. The stretch bag 42 is secured in a bunched manner to a carrier the stretches the stretch bag 42 to define an opening having a large diameter. The large diameter is reduced by radially stretching the stretch bag 42 prior to filling and, after filling substantially to the fill level, releasing a stretched portion of the stretch bag 42 at a level slightly below the fill level in the bag 48. The carrier includes a stretching device to radially stretch the stretch bag 42 prior to filling.

The flexible bag 48 is placed through the large diameter opening in the stretch bag 42 such that the stretch bag 42 surrounds the flexible bag 48. As the flexible bag 48 receives bulk goods from the feed source 50, a predetermined length of the stretch bag 42 is released with respect to the transportable container 20 at a level slightly below the fill level in the bag 48. During the filling process, the predetermined length of the stretch bag 42 can be selected based on the filling rate. For example, a greater length of the stretch bag 42 can be released in response to a high fill rate. Alternatively, the length can be selected based on the density of the bulk goods. For example, a greater length of the stretch bag 42 can be released in response to higher density bulk goods. The stretch bag 42 can be incrementally released from the bunched orientation or continuously released.

In the exemplary embodiment, the closed base 54 of the flexible bag 48 is disposed adjacent the transporter base 22. The stretch bag 42 is released from the carrier and reduced to a smaller fill diameter at the wall 66 of the transporter base 22. The lips 70 of the transporter base 22 maintain the position of the stretch bag 42 with respect to the transporter base 22. The flexible bag 48 is filled with a plurality of bulk goods through the open top 52 of the flexible bag 48. The opening of the stretch bag 42 is reduced to a smaller fill diameter at a level slightly below the fill level in the bag 48. The opening of the stretch bag 42 is reduced to a smaller fill diameter at a level a level slightly below the fill level in the bag 48 as the fill level rises during filling of the flexible bag 48. As bulk goods are added to the bag 48, the walls 66 of the transporter base 22 will initially shape the transportable container 20. As the level of bulk goods rises, the stretch bag 42 is released and reduced to the smaller diameter to create the transportable container 20. The bulk goods will want to maintain the initial shape of the transporter base 22.

In an alternative embodiment, a slip frame former 24 may be used with the pallet 60 and slip sheet 62 embodiment or with the transporter base 22. The closed base 54 of the flexible bag 48 is disposed adjacent the transporter base 22 or slip sheet 62 on the frame base 30. The stretch bag 42 is released from the carrier and reduced to a smaller fill level at the wall 66 of the transporter base 22 or the slip sheet 62. A slip frame former 24 is initially spaced from the transporter base 22. As the bulk goods are added to the bag 48, the transporter base 22 will initially shape the bag 48. The slip frame former 24 will hold the shape of the transporter base 22 and continue to shape the bag 48 into the transportable container 20. The opening of the stretch bag 42 is reduced to the smaller fill diameter substantially at the slip frame former 24 as the fill level rises during filling of the flexible transportable container 20. As discussed above, the slip frame former 24 may include a Teflon coating or dimpled surface, particularly on the corners of the former walls 76 or the downwardly extending arms 80. The Teflon coating allows for the slip frame former 24 to be easily pulled away from the stretch bag 42 as the slip frame former 24 moves relative to the frame base 30 in response the level of bulk goods.

The reduction of the stretch bag 42 at the slip frame former 24, by releasing a stretched portion of the stretch bag 42 at the fill level, generates hoop forces which apply a gentle squeeze to the bulk goods, helping to support and firm them. The hoop forces stabilize the bulk goods by promoting controllable contact between the elements of the bulk goods being loaded into the stretch bag 42, thereby promoting bridging between the components of the bulk goods.

In an alternative embodiment, the stretch wrapping device 36 may apply a heat shrink film 44 in place of the outer wrap 40 or stretch bag 42 to form the transportable container 20. The heat shrink film 44 is preferably a stretch wrap 38 having a high cling factor, but the heat shrink film 44 may be any of a variety of stretch wrap 38 films known in the art. The heat shrink film 44 is secured in a bunched manner to a carrier the stretches the heat shrink film 44 to define an opening having a large diameter. The apparatus provided by the invention includes a shrinking device to shrink the large diameter of the heat shrink film 44 to a small fill diameter. The shrinking device can include a heater to direct heat at the heat shrink film 44 at a level slightly below the fill level of the bulk goods to shrink the large diameter to the small fill diameter. Preferably, the shrinking device is kept within plus or minus twelve inches of the fill level.

The flexible bag 48 is placed through the large diameter opening in the heat shrink film 44 such that the heat shrink film 44 surrounds the flexible bag 48. As the flexible bag 48 receives bulk goods from the feed source 50, a predetermined length of the heat shrink film 44 is released with respect to the transportable container 20 at a level slightly below the fill level in the bag 48. During the filling process, the predetermined length of the heat shrink film 44 can be selected based on the filling rate. For example, a greater length of the heat shrink film 44 can be released in response to a high fill rate. Alternatively, the length can be selected based on the density of the bulk goods. For example, a greater length of the heat shrink film 44 can be released in response to higher density bulk goods. The heat shrink film 44 can be incrementally released from the bunched orientation or continuously released.

In the exemplary embodiment, the closed base 54 of the flexible bag 48 is disposed adjacent the transporter base 22. The heat shrink film 44 is released from the carrier and reduced to the smaller fill diameter at the wall 66 of the transporter base 22. The lips 70 of the transporter base 22 maintain the position of the heat shrink film 44 with respect to the transporter base 22. The flexible bag 48 is filled with a plurality of bulk goods through the open top 52 of the flexible bag 48. The opening of the radially flexible heat shrink film 44 is reduced to the smaller fill diameter at a level slightly below the fill level in the bag 48. The large diameter opening of the heat shrink film 44 is reduced to the smaller fill diameter at a level a level slightly below the fill level in the bag 48 as the fill level rises during filling of the flexible bag 48. As bulk goods are added to the bag 48, the walls 66 of the transporter base 22 will initially shape the transportable container 20. As the level of bulk goods rises, the heat shrink film 44 is released and reduced to the smaller fill diameter to create the transportable container 20. The bulk goods will want to maintain the initial shape of the transporter base 22.

In an alternative embodiment, a slip frame former 24 may be used with the pallet 60 and slip sheet 62 embodiment or with the transporter base 22. The closed base 54 of the flexible bag 48 is disposed adjacent the transporter base 22 or slip sheet 62 on the frame base 30. The heat shrink film 44 is released from the carrier and reduced to the smaller fill level at the wall 66 of the transporter base 22 or the slip sheet 62. A slip frame former 24 is initially spaced from the transporter base 22. As the bulk goods are added to the bag 48, the transporter base 22 will initially shape the bag 48. The slip frame former 24 will hold the shape of the transporter base 22 and continue to shape the bag 48 into the transportable container 20. The opening of the heat shrink film 44 is reduced to the smaller fill diameter substantially at the slip frame former 24 as the fill level rises during filling of the flexible transportable container 20. As discussed above, the slip frame former 24 may include a Teflon coating or dimpled surface, particularly on the corners of the former walls 76 or the downwardly extending arms 80. The Teflon coating allows for the slip frame former 24 to be easily pulled away from the heat shrink film 44 as the slip frame former 24 moves relative to the frame base 30 in response the level of bulk goods.

The reduction of the heat shrink film 44 at the slip frame former 24, by releasing a stretched portion of the heat shrink film 44 at the fill level, generates hoop forces which apply a gentle squeeze to the bulk goods, helping to support and firm them. The hoop forces stabilize the bulk goods by promoting controllable contact between the elements of the bulk goods being loaded into the heat shrink film 44, thereby promoting bridging between the components of the bulk goods.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of producing a transportable container for bulk goods comprising the steps of:

placing a bag with an open top and a closed base through a former opening defined by a slip frame former having at least one wall, the slip frame former surrounding a portion of the bag with the closed base being disposed adjacent a bottom support and the open top being vertically spaced from the closed base and disposed adjacent a feed source;

filling the bag with bulk goods from the feed source through the open top;

disposing a stretch wrap from a stretch wrapping device radially about the bottom support and a portion of the at least one former wall of the slip frame former to initially form the transportable container;

monitoring a fill level of the bulk goods in the bag with a fill sensor while filling the bag;

vertically moving at least one of the slip frame former and the bottom support relative to other of the slip frame former and the bottom support in response to the fill level of the bulk goods in the bag to expose the filled portion of the bag therebetween as the bag is filled with bulk goods, the slip frame former being maintained in a position to surround the fill level of the bulk goods in the bag;

disengaging previously disposed portions of stretch wrap from the slip frame former to squeeze the filled portions of the bag and lock together the bulk goods disposed in the bag as the at least one of the slip frame former and the bottom support moves relative to the other of the slip frame former and the bottom support; and disposing additional portions of stretch wrap around a portion of the at least one wall of the slip frame former to maintain the transportable container for receiving bulk goods as previously disposed portions of stretch wrap disengage the at least one wall of the slip frame former.

2. The method as set forth in claim 1 wherein the bottom support is a transporter base having a bottom defining a periphery and at least one wall extending upwardly from the periphery to a wall end to define a shaping area.

3. The method as set forth in claim 2 wherein the transporter base includes at least one pair of recesses extending upwardly from the bottom of the transporter base to permit the entry of the tines of a lifting and transporting device and further including the steps of:

engaging the recesses with the tines of a transporting device; and transporting the transportable container away from the feed source.

4. The method as set forth in claim 2 further including the step of placing the slip frame former vertically above the transporter base prior to placing the bag through a former opening.

5. The method as set forth in claim 4 wherein the placing the slip frame former step is further defined as placing a slip frame former having at least one former wall defining a former opening vertically above a transporter base having a bottom defining a periphery and at least one wall extending upwardly from the periphery to define a shaping area, the shape of the former opening corresponding to the shape of the shaping area.

6. The method as set forth in claim 5 wherein the slip frame former includes one continuous former wall, the transporter base includes one continuous wall, and the shape of the former opening and the transporter base are circular.

7. The method as set forth in claim 5 wherein the slip frame former includes a plurality of former walls, the transporter base includes a plurality of walls, and the shape of the former opening and the transporter base are square.

8. The method as set forth in claim 1 further including the step of maintaining the shape of the former opening as the at least of the slip frame former and bottom support moves relative to other of the slip frame former and the bottom support.

9. The method as set forth in claim 1 wherein the disposing a stretch wrap step is further defined as applying an outer wrap from a stretch wrap roll spirally about the bottom support and a portion of the at least one former wall of the slip frame former to initially form the transportable container.

10. The method as set forth in claim 9 wherein the disposing additional portions of stretch wrap step is further defined as applying additional portions of the outer wrap spirally about a portion of the at least one wall of the slip frame former to maintain the transportable container for receiving bulk goods as previously disposed portions of outer wrap disengage the at least one wall of the slip frame former.

11. The method as set forth in claim 1 wherein the disposing a stretch wrap step is further defined as applying a stretch bag from a carrier radially about the bottom support and a portion of the at least one former wall of the slip frame former to initially form the transportable container by reducing the stretch bag from a large diameter on the carrier to a smaller fill diameter at the bottom support and slip frame former.

12. The method as set forth in claim 11 wherein the disposing additional portions of stretch wrap step is further defined as applying additional portions of the stretch bag radially about a portion of the at least one wall of the slip frame former by reducing the stretch bag from the large diameter on the carrier to the smaller fill diameter at the slip frame former to maintain the transportable container for receiving bulk goods as previously disposed portions of the stretch bag disengage the at least one wall of the slip frame former.

13. The method as set forth in claim I wherein the disposing a stretch wrap step is further defined as applying a heat shrink film from a carrier radially about the bottom support and a portion of the at least one former wall of the slip frame former to initially form the transportable container by heating the heat shrink film to reduce the heat shrink film from a large diameter on the carrier to a smaller fill diameter at the bottom support and slip frame former.

14. The method as set forth in claim 13 wherein the disposing additional portions of stretch wrap step is further defined as applying additional portions of the heat shrink film radially about a portion of the at least one wall of the slip frame former by heating the heat shrink film to reduce the heat shrink film from a large diameter on the carrier to a smaller fill diameter at the slip frame former to maintain the transportable container for receiving bulk goods as previously disposed portions of the heat shrink film disengage the at least one wall of the slip frame former.

15. The method as set forth in claim 1 wherein the vertically moving step is further defined as vertically moving the slip frame former upwardly relative to the stationary bottom support in response to the fill level of the bulk goods in the bag to expose the filled portion of the bag therebetween as the bag is filled with bulk goods, the slip frame former being maintained in a position to surround the fill level of the bulk goods in the bag.

16. The method as set forth in claim 1 wherein the vertically moving step is further defined as vertically moving the bottom support downwardly relative to the stationary slip frame former in response to fill level of the bulk goods in the bag to expose the filled portion of the bag therebetween as the bag is filled with bulk goods, the slip frame former being maintained in a position to surround the fill level of the bulk goods in the bag.

17. The method as set forth in claim 1 wherein the bottom support is a slip sheet being disposed on a pallet.

18. A method of forming a transportable container for bulk goods with a transporter base having a periphery and a wall extending upwardly from the periphery of the transporter base to wall end with a radially extending lip, the inner surfaces of the upwardly extending wall defining a shaping area and further having at least one pair of recesses extending upwardly from the bottom of the transporter base to permit the entry of the tines of a lifting and transporting device, comprising the steps of:

placing the transporter base below a feed source;

placing a bag with an open top and a closed base between the transporter base and the feed source, the closed bottom being disposed within the shaping area of the transporter base and the open top being disposed adjacent the feed source;

filling the bag through the open top from the feed source with bulk goods that conform to the shape of the shaping area;

monitoring a fill level of the bulk goods in the bag while filling the bag;

disposing a portion of stretch wrap around the wall and the radially extending lip of the transporter base and a portion of the bag at a level below the fill level of bulk goods in the bag to initially form the transportable container;

vertically moving the transporter base relative to the feed source in response to the fill level of the bulk goods in the bag as the bag is filled with bulk goods; and disposing additional portions of stretch wrap around the bag while filling the bag, the stretch wrap being maintained at a level below the fill level of the bulk goods to maintain the shape of the transporter base and to squeeze the bag and lock together the bulk goods disposed in the bag as fill level of the bulk goods in the bag increases.

19. The method as set forth in claim 18 wherein the disposing a stretch wrap step is further defined as applying an outer wrap from a stretch wrap roll spirally about the transporter base and a portion of the bag at a level below the fill level of bulk goods in the bag to initially form the transportable container.

20. The method as set forth in claim 19 wherein the disposing additional portions of stretch wrap step is further defined as applying additional portions of the outer wrap spirally about a portion of the bag at a level below the fill level of bulk goods in the bag to maintain the shape of the transportable container for receiving bulk goods as the fill level of bulk goods increases.

21. The method as set forth in claim 18 wherein the disposing a stretch wrap step is further defined as applying a stretch bag from a carrier radially about the transporter base and a portion of the bag at a level below the fill level of bulk goods in the bag by reducing the stretch bag from the large diameter on the carrier to the smaller fill diameter at the transporter base and at a level below the fill level of bulk goods in the bag to initially form the transportable container.

22. The method as set forth in claim 21 wherein the disposing additional portions of stretch wrap step is further defined as applying additional portions of the stretch bag radially about a portion of the bag at a level below the fill level of bulk goods in the bag by reducing the stretch bag from the large diameter on the carrier to the smaller fill diameter at a level below the fill level of bulk goods in the bag to maintain the shape of the transportable container for receiving bulk goods as the fill level of bulk goods increases.

23. The method as set forth in claim 18 wherein the disposing a stretch wrap step is further defined as applying a heat shrink film from a carrier radially about the transporter base and a portion of the bag at a level below the fill level of bulk goods in the bag by heating the heat shrink film to reduce the heat shrink film from a large diameter on the carrier to a smaller fill diameter at the bottom support and at a level below the fill level of bulk goods in the bag to initially form the transportable container.

24. The method as set forth in claim 23 wherein the disposing additional portions of stretch wrap step is further defined as applying additional portions of the heat shrink film radially about a portion of the bag at a level below the fill level of bulk goods in the bag by heating the heat shrink film to reduce the heat shrink film from a large diameter on the carrier to a smaller fill diameter at a level below the fill level of bulk goods in the bag to maintain the shape of the transportable container for receiving bulk goods as the fill level of bulk goods increases.

25. The method as set forth in claim 18 wherein the vertically moving step is further defined as vertically moving the feed source upwardly relative to the stationary transporter base in response to the fill level of the bulk goods in the bag.

26. The method as set forth in claim 18 wherein the vertically moving step is further defined as vertically moving the transporter base downwardly relative to the stationary feed source in response to the fill level of the bulk goods in the bag.

* * * * *

UNITED STATES PATENT AND TRADEMARK OFFICE

CERTIFICATE OF CORRECTION

PATENT NO. : 7,921,624 B2
APPLICATION NO. : 12/478800
DATED : April 12, 2011
INVENTOR(S) : Dave Ours and Sharon Juntunen It is certified that error appears in the above-identified patent and that said Letters Patent is hereby corrected as shown below:

Column 6, Line 15: “goods” should read -- goods. --.

Column 8, Line 51: “fiction” should read -- friction --.

Signed and Sealed this
Seventeenth Day of May, 2011

David J. Kappos

David J. Kappos
*Director of the United States Patent and Trademark Office*